US005419306A

United States Patent [19]

Huffman

[11] Patent Number: 5,419,306

[45] Date of Patent: May 30, 1995

[54] APPARATUS FOR HEATING LIQUIDS

[76] Inventor: Michael T. Huffman, 1825 Nagle Pl. #210, Seattle, Wash. 98122

[21] Appl. No.: 318,068

[22] Filed: Oct. 5, 1994

[51] Int. Cl.[6] ..... F24C 9/00

[52] U.S. Cl. ..... 126/247; 122/26; 416/223 B

[58] Field of Search ..... 126/247; 122/26; 237/1 R; 416/223 B

[56] References Cited

U.S. PATENT DOCUMENTS

| | | | |
|---|---|---|---|
| 3,791,349 | 2/1974 | Schafer | 122/11 |
| 4,696,283 | 9/1987 | Kohlmetz | 126/247 |
| 4,798,176 | 1/1989 | Perkins | 126/247 |
| 5,188,090 | 2/1993 | Griggs | 126/247 |
| 5,279,262 | 1/1994 | Muehleck | 126/247 |
| 5,341,768 | 8/1994 | Pope | 126/247 |

*Primary Examiner*—James C. Yeung
*Attorney, Agent, or Firm*—Craine & Jackson

[57] ABSTRACT

An apparatus which uses friction to generate heat for heating liquids. The apparatus includes a cylindrical rotor disk housed inside a close-fitting housing structure. The rotor disk is connected to the shaft of a motor which turns the rotor disk at high revolutions inside the rotor chamber of the housing structure. The rotor disk has a plurality of curved, outward radiating, closed-end passageways formed therein. During operation, liquid flows into the housing structure via an inlet port which fills the rotor chamber of the housing structure and the curved passageways in the rotor disk. When the rotor disk is rotated at high speeds, the liquid located inside the curved passageways is pulled outward by centrifugal forces which creates a vacuum therein. When the vacuum becomes sufficient, the liquid "cracks" or boils at a low temperature. The resulting vapor formed inside the curved passageway suddenly forces the liquid remaining inside the curved passageway outward and exit at relatively high speed. The exiting liquid pushes against the leading inside surface of the curved passageway to help turn the rotor disk thereby increasing the efficiency of the apparatus. As the vapor in the curved passageway cools, it condenses to create a vacuum therein which draws the liquid back therein. When the liquid in the housing structure has reach a desired temperature, the vapor and the liquid is then allowed to exit via outlet ports.

15 Claims, 4 Drawing Sheets

APPARATUS FOR HEATING LIQUIDS

BACKGROUND OF THE INVENTION

1. Field of the Invention

This invention relates to apparatus used to heat liquids and, more particularly, to such apparatus designed to generate heat by friction.

2. Description of the Related Art

Various steam generators or liquid heating apparatus have been developed which use friction to generate heat. For example, Schaefer, (U.S. Pat. No. 3,791,349), discloses an elaborate apparatus and method for producing pressurized steam by creating shock waves in a distended body of water. The rotor in this apparatus presents a complex and tortuous passageway to create the amount of water hammer necessary to effect a significant rise in the temperature of the water. In Griggs, (U.S. Pat. No. 5,188,090), an apparatus for heating liquids is disclosed having a cylindrical rotor which features surface irregularities. The rotor is rotated in a housing filled with a liquid to be heated. Shock waves are also produced in this apparatus to heat the liquid.

While the apparatus found in the prior art have been shown to be reasonably efficient in generating heat and/or pressure in water and other liquids compared to more traditional methods (i.e., burning fossil fuels or using electrical resistance coils), all of the apparatus found in the prior art are relatively complex structures which use internal support bearings and shaft seals which require periodic maintenance and replacement. More importantly, none of the apparatus found in the prior art are capable of using water hammer to generate usable mechanical energy as well as thermal energy. An apparatus which generates heat in liquids, which has no support bearings, shaft seals or any other mechanical friction points, which will never wear out or require maintenance of any kind, which is simple to understand and operate, which is simple and less expensive to manufacture, and which operates more efficiently due to its ability to generate useable mechanical energy is clearly and greatly needed.

SUMMARY OF THE INVENTION

It is an object of the invention to provide an apparatus for heating or vaporizing liquids.

It is another object of the invention to provide an apparatus which uses "water hammer" to affect a significant rise in the temperature of the liquid.

It is a further object of the invention to provide such an apparatus which is more efficient to operate, with increased reliability and service life, than other apparatus currently found in the prior art.

These and other objects are met by providing an apparatus which uses "water hammer" to frictionally generate heat for heating liquids. The apparatus includes a disk-shaped rotor disk housed inside the rotor chamber of a closed housing structure. In the preferred embodiment, the rotor disk is connected to a motive means which turns the rotor disk at relatively high revolutions per minute in one direction, for example in a counter-clockwise direction, inside the rotor chamber of the housing structure. The rotor disk has a plurality of relatively long, outward radiating, closed-end, curved passageways formed therein. The curved passageways arc in a direction opposite the rotor disk's direction of rotation. During operation, cool liquid is delivered to the rotor chamber via an inlet port which fills the rotor chamber and the curved passageways with the liquid. When the rotor disk is rotated at high speeds, liquid in the curved passageways is forced outward by centrifugal forces which creates a vacuum therein. When the vacuum inside the curved passageways becomes sufficient, the liquid remaining inside the curved passageway "cracks" or begins to boil at a relatively low temperature. The vapor formed inside the curved passageway suddenly forces any remaining liquid located therein outward at relatively high speed. As the liquid exits the curved passageway, it pushes against the leading edge of the curved passageway which helps turn the rotor disk in a direction of rotation of the motor. By providing a force which helps rotate the rotor disk inside the housing structure in this manner, the efficiency of the apparatus is markedly improved over other liquid heaters found in the prior art.

As the vapor in the curved passageway cools, it condenses and collapses which draws liquid located in the rotor chamber and around the rotor disk partially back into the curved passageways. As the pressure in the curved passageways drops, the vapor located therein also condenses. These activities in the curved passageways are repeated with high frequency, which causes a significant rise in the overall temperature of the liquid contained in the housing structure.

During operation, the vapor and heated liquid in the rotor chamber of the housing structure gradually migrate to the fluid separation chamber located in the rear section of the housing structure. A vapor outlet port and a liquid outlet port are provided in the fluid separation chamber which allow the vapor and heated liquid to exit the housing structure.

BRIEF DESCRIPTION OF THE DRAWINGS

FIG. 5(*b*) is a cross-sectional view of a curved passageway filled with the column of liquid being pulled outward by centrifugal forces.

FIG. 5(*c*) is a cross-sectional view of a curved passageway filled with the column of liquid with the inner portion of the column of liquid boiling and causing increase pressure which rapidly forces the column of liquid out of the curved passageway.

DESCRIPTION OF THE PREFERRED EMBODIMENT(S)

Figure 1:
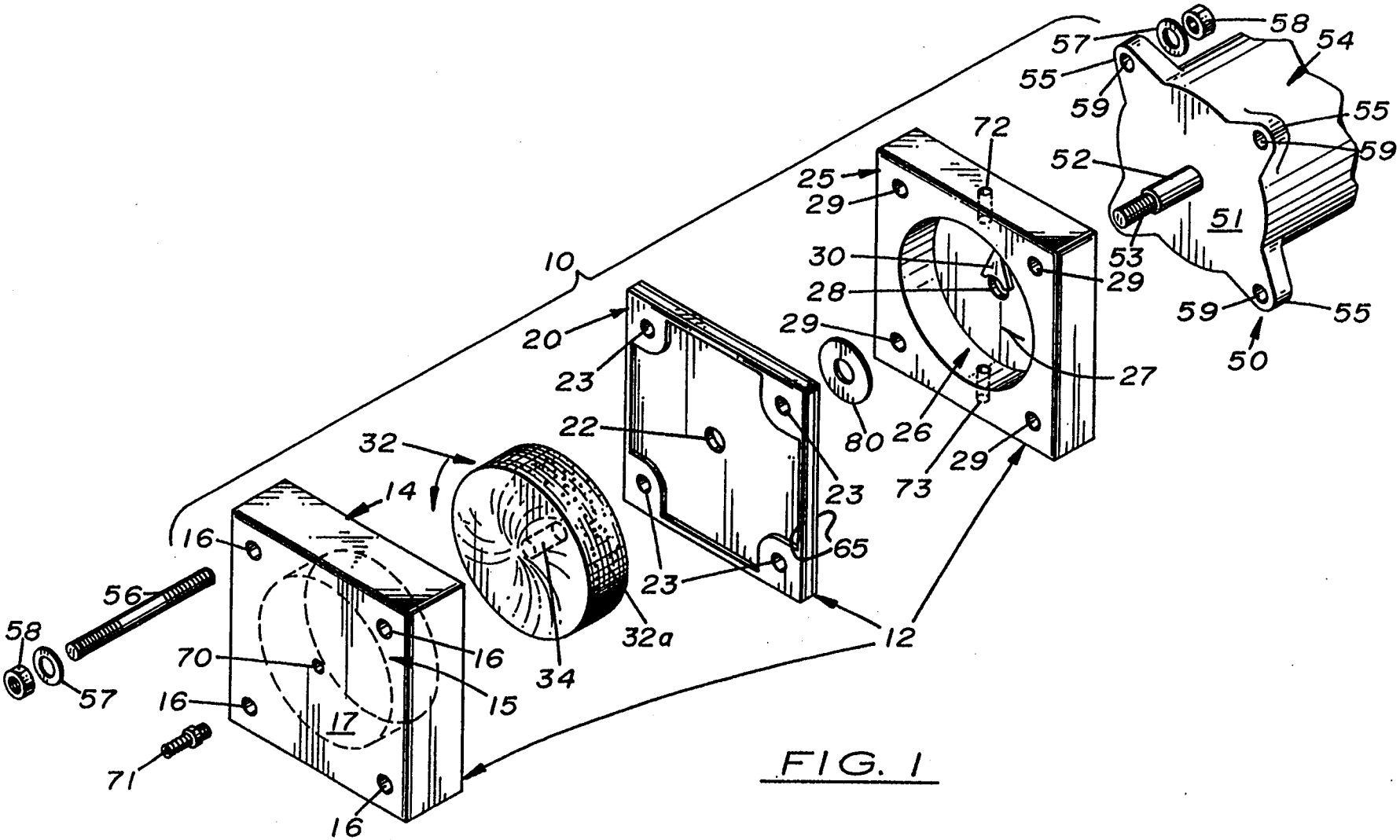
FIG. 1 is an exploded, perspective view of the invention disclosed herein.

Shown in the accompanying FIGS. 1–4, there is shown a apparatus, generally referred to as 10, designed to heat liquids using the water hammer effect. The apparatus 10 includes a closed housing structure 12 which houses a rotor disk 32 which rotates at relatively high RPM's to heat the liquid contained in the front section 14 of the housing structure 12 using the water hammer effect. The rotor disk 32 is connected to the rotating shaft 52 of a motor 50 attached to one end of the housing structure 12.

The housing structure 12 comprises front and rear sections 14, 25, respectively, separated by a traversely aligned separation plate 20. The front section 14 has a cylindrical-shaped rotor chamber 15 formed on one surface therein which is designed to receive and allow rotation therein of the rotor disk 32. The front section 14 of the housing structure 12 surrounds the rotor disk 32 in close proximity. In the preferred embodiment, the diameter of the rotor chamber 15 is approximately ⅛ inch greater than the diameter of the rotor disk 32 thereby creating a 1/16 inch space between the outer surface of the rotor disk 32 and the inside surface of the rotor chamber 15. The length of the rotor chamber 15 is slightly larger that the length of the rotor disk 32. A hole 70 is manufactured centrally on the distal end surface 17 of the front section 14 which receives a fitting 71 to provide a liquid input port for the housing structure 12. The shape and dimension of the liquid input port may be such that flow limiting capabilities and shearing forces are exhibited when so desired. The interior walls of the front section 14 can be smooth, rough, or possess slight surface irregularities to enhance the performance of the apparatus 10.

The separation plate 20 is a planar structure disposed between the adjoining surfaces of the front and rear sections 14, 25, respectively. The separation plate 20 is used to separate the rotor chamber 15 from the fluid separation chamber 26 discussed further herein. Manufactured centrally on the separation plate 20 is a shaft bore 22 through which the shaft 52 from motor 50 may be extended. The diameter of shaft bore 20 is larger than the diameter of the shaft 52 to enable heated liquid and vapor to easily pass from the front chamber 15 to the fluid separation chamber 26, respectively, during operation of the apparatus 10. Two optional gaskets 65 may be attached near the peripheral edges to the opposite planar surfaces of the separation plate 20 to provide an air tight seal between the front and rear sections 14, 25, respectively, when the housing structure 12 is assembled.

The rear section 25 is disposed between the separation plate 20 and the motor 50. The rear section 25 has a fluid separation chamber 26 formed therein designed to receive heated liquid and vapor from the rotor chamber 15 during operation. As heated liquid and vapor enters the fluid separation chamber 26, the heated liquid to falls to the bottom of the fluid separation chamber 26 while the vapor rises to the top. A longitudinally aligned, central shaft bore 28 is manufactured centrally through the end surface 27 of the rear section 25 which enables the shaft 52 of motor 50 extend into the housing structure 12. The diameter of the hole 28 is slightly larger than the diameter of the shaft 52 so that rear section 25 may be assembled on the shaft 52. Manufactured on the upper portion of the rear section 25 is a second bore 72 which, during operation, acts as a vapor outlet port. Also, a third bore 73 is manufactured on the lower portion of the rear section 25 which, during operation, acts as liquid outlet port. The internal shape and dimensions of the fluid separation chamber 26 and the second and third bores 72, 73, respectively, need only be sufficient to accommodate the maximum flow rate expected without flooding the fluid separation chamber.

A triangular shaped drip diverter 30 is attached to the inside surface of the back wall 27 of the rear section 25. The apex of the drip diverter 30 points upward and is located immediately above the central shaft bore 28. The drip diverter 30 acts to prevent condensation which forms on the inside surface of the back wall 27 from falling directly onto the shaft 52 during operation.

A washer-like, shaft slinger 80 is disposed on the shaft 52 inside the rear chamber 26 adjacent to the back surface of the separation plate 20. The shaft slinger 80 acts to prevent the liquid from exiting from the fluid separation chamber 26 to the rotor chamber 15 via the central shaft bore 22. A simple impeller may be substituted for the shaft slinger 80 in applications where the exiting liquid needs to have some head pressure.

The front section 14, separation plate 20, and the rear section 25 are aligned and assembled parallel to the longitudinal axis of the shaft 52. Four bolts 56 are used to attach the housing structure 12 to the front surface 51 of the motor 50. The bolts 56 are aligned substantially perpendicular to the front surface 51 and extended through holes 59 manufactured on the arms 55 integrally formed on the motor body 54. The bolts 56 extend through holes 16, 23, and 29 manufactured on the front section 14, separation plate 20, and rear section 25, respectively. Nuts 58 with optional washers 57 are attached to the opposite, threaded ends of bolts 56 to tightly hold the front section 14, separation plate 20, rear section 25 together.

The rotor disk 32 is attached to the distal end of the shaft 52. The rotor disk 32 has a threaded, central bore 34 manufactured therein which connects to external threads 53 located near the distal end of the shaft 52. As shown more clearly in FIGS. 3 and 4, the rotor disk 32 has a plurality of long, outward radiating, curved passageways 35 formed therein. The curved passageways 35 are closed at the end nearest the center of the rotor disk 32 and opened at the circumferential surface of the rotor disk 32. In cross section, the internal walls of the curved passageways 35 may be defined as, but not limited to round, square or hexagonal in shape. The surface of the internal walls of the curved passageways 35 may be rough, smooth, or rifled in texture. The outer openings of the curved passageways 35 may be a different dimension and shape than the internal walls of the curved passageway 35.

In the embodiment shown, the curvature of the curved passageways 35 forms an arc whose tangent intersects at an angle of 45 degrees, a line drawn radially from the starting point of the arc to the circumferential edge of the rotor disk 32 at an angle of 0 degrees. The length of the curved passageways 35 can vary between 10 to 20% of the radius of the rotor disk 32. Other shapes of arcs or curves and lengths may be employed depending on their suitability or advantage for a given application.

In the preferred embodiment, the housing structure 12 is made of clear acrylic material and the rotor disk 32 is constructed on 21 clear acrylic plates approximately 1/16 inch thick, solvent welded together on the annular sides. Clear acrylic was used for its low cost, superior melting temperature, and its ability to facilitate the observation of the dynamics of the liquid during operation. It should be understood that the housing structure 12 and the rotor disk 32 may be made of other suitable materials, such as ceramic, glass, which are heat resistant, corrosion resistant, and durable. The diameter of the curved passageways 35 is approximately 1/16 inch in diameter.

In the preferred embodiment, an electric motor 50 and shaft 52 are used as a motive means to rotate the rotor disk 32 at approximately 3,450 RPMs. It should be understood that other types of motive means may be used in place of motor 50 and shaft 52, such as a magnetic drive coupler located outside the housing structure 12.

DETAILS OF OPERATION

Figure 2:
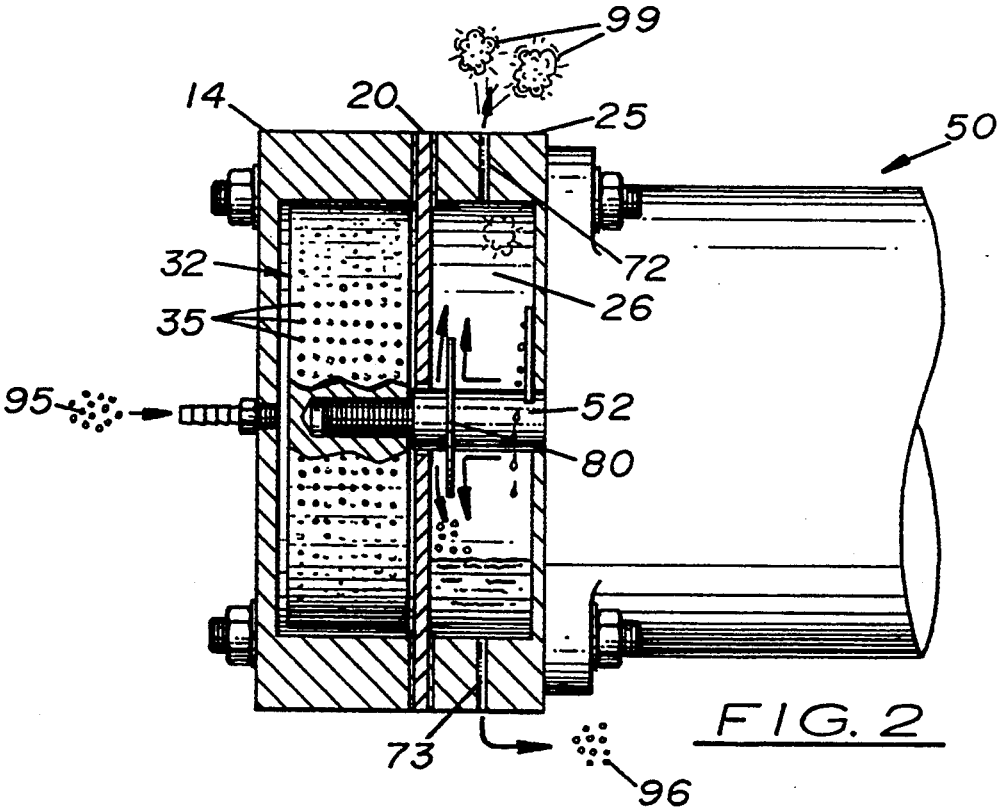
FIG. 2 is a side elevational view of the invention, partly in section, of the invention disclosed herein.
Figure 3:
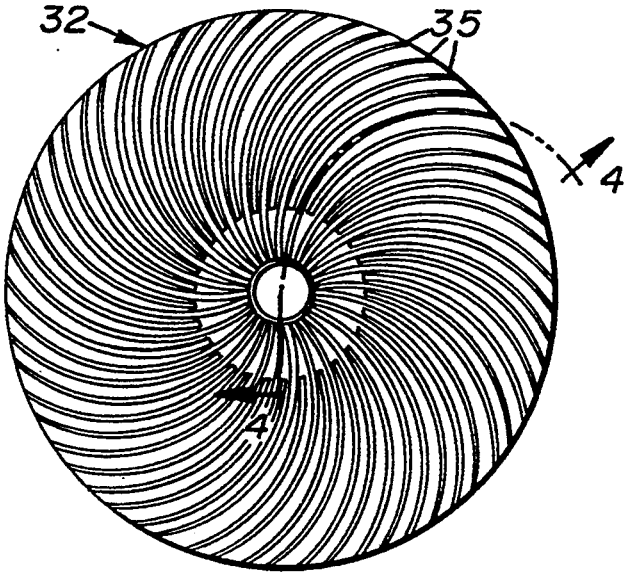
FIG. 3 is a front elevational view of the rotor disk.
Figure 4:
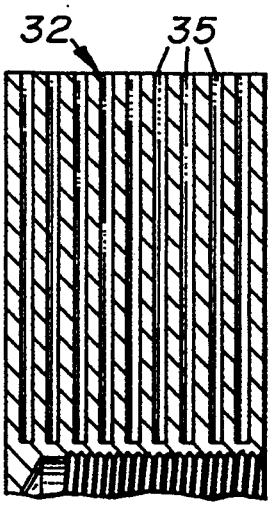
FIG. 4 is a side elevational view in section as viewed along line 4—4 in FIG. 3.

Referring to FIG. 2, operation of the apparatus 10 is begun by delivering cool liquid 95 into the housing structure 12 via the liquid inlet port located on the front section 15 until the rotor chamber 15 in the front section 14 and the curved passageways are partially filled with fluid. A small air bubble, denoted "A" in FIG. 5(*a*), remains trapped in the bottom of the curved passageway 35. When the rotor chamber 15 is approximately one-third full, the motor 50 is activated to rotate the rotor disk 32 in a counter-clockwise direction at approximately 3,450 revolutions per minute. More cool liquid 95 is then gradually added until the rotor chamber 15 is nearly full. The flow of the cool liquid 95 is then temporarily halted until the liquid 95 inside the rotor chamber 15 reaches a desired temperature. The flow of the liquid 95 is then resumed at the proper rate to maintain a constancy in the temperature of exiting heated liquid 96.

Figure 5A:
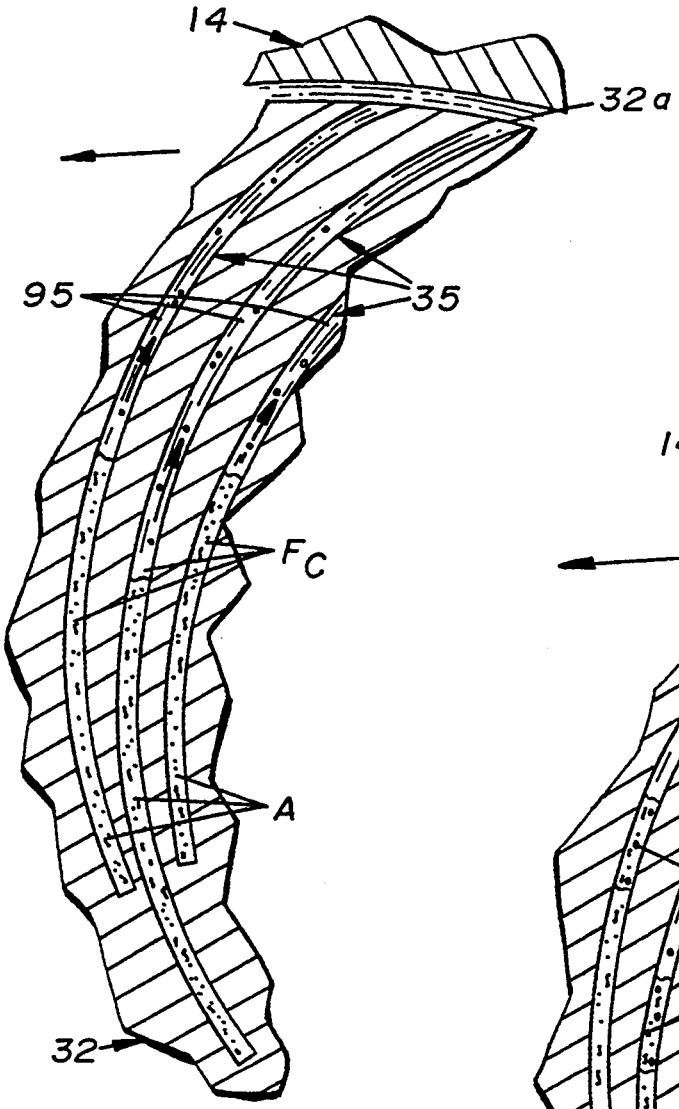
FIG. 5(*a*) is a cross-sectional view of a curved passageway filled with a column of liquid.
Figure 5B:
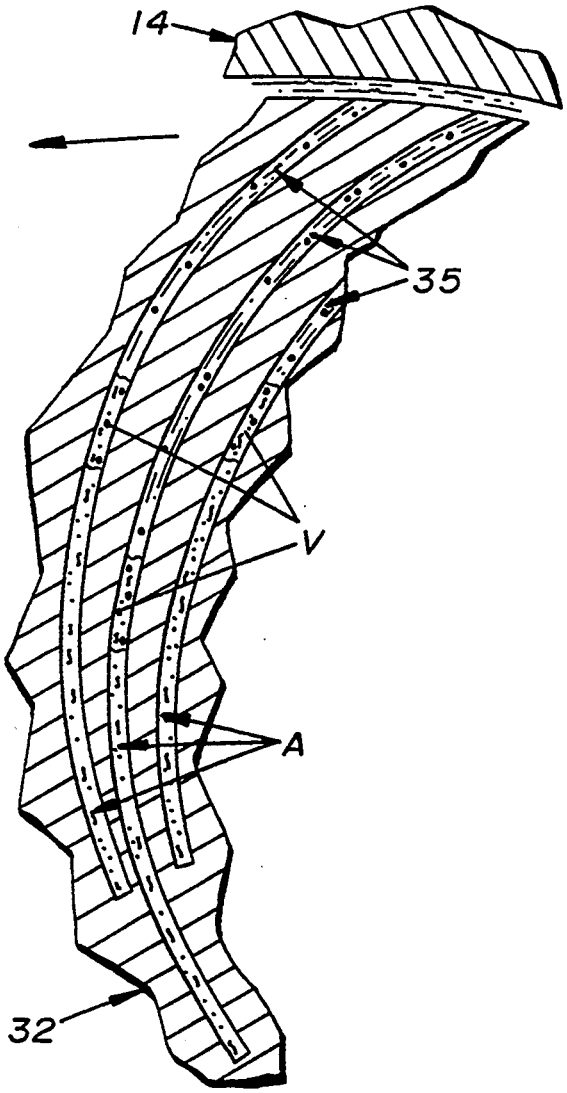
Figure 5C:
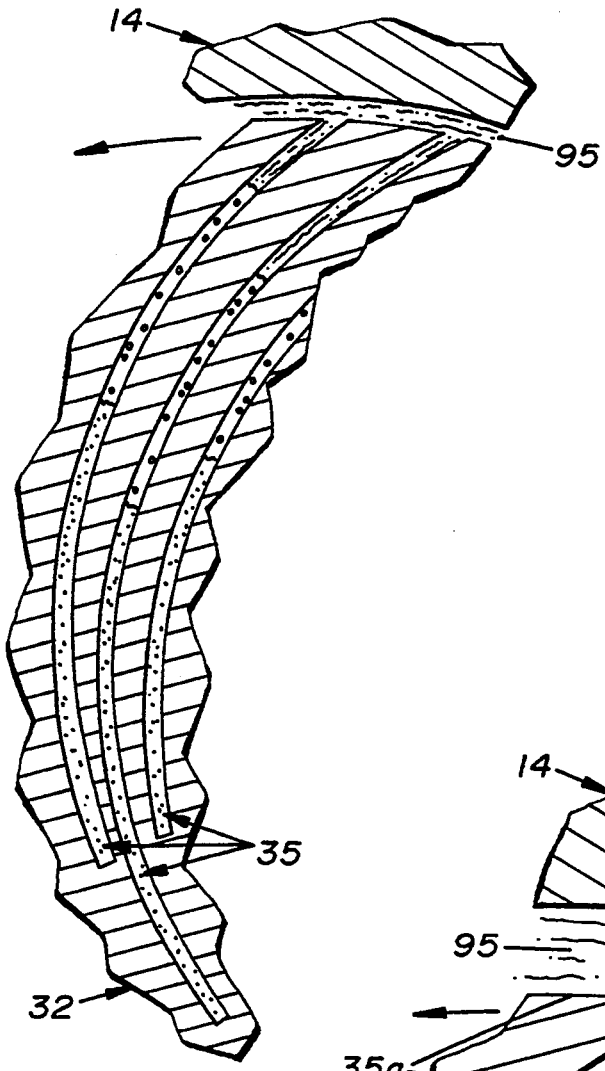

It is postulated that as the rotor disk 32 is rotated at high speed, liquid 95 in the curved passageways 35 is pulled radially outward, away from the center of the rotor disk 32 by centrifugal force "F(c)" as shown in FIG. 5(*a*). This centrifugal force "F(c)", in turn, creates a vacuum in the curved passageways 35. When the vacuum is sufficient to overcome the cohesive force bonding the molecules of the liquid 95 together, the liquid immediately adjacent to the air bubble trapped at the bottom of the curved passageways 35 "cracks" or boils at a low temperature. The cohesive force of the liquid 95 is lesser in the area adjacent to the air bubble so it is in this area that "cracking" occurs. As the liquid 95 is converted into a vapor, denoted "V" in FIG. 5(*b*), it suddenly expands to many times its original volume, and forces the remaining liquid 95 in the curved passageways 35 directly outward, away from the center of the rotor disk 32 as shown in FIG. 5(*c*). For the sake of simplicity, this will be referred to as the "expansion phase" of the cycle. A volume of liquid 95 equal to the volume of the newly formed vapor bubble exits the curved passageways 35 at high speed via the respective openings located at the circumferential sides, denoted 32(*a*), of the rotor disk 32, and mixes with the circumjacent liquid 95 surrounding the rotor disk 32. A smaller volume of liquid 95 will remain in the extremities of the curved passageways 35 for reasons explained below.

Figure 6:
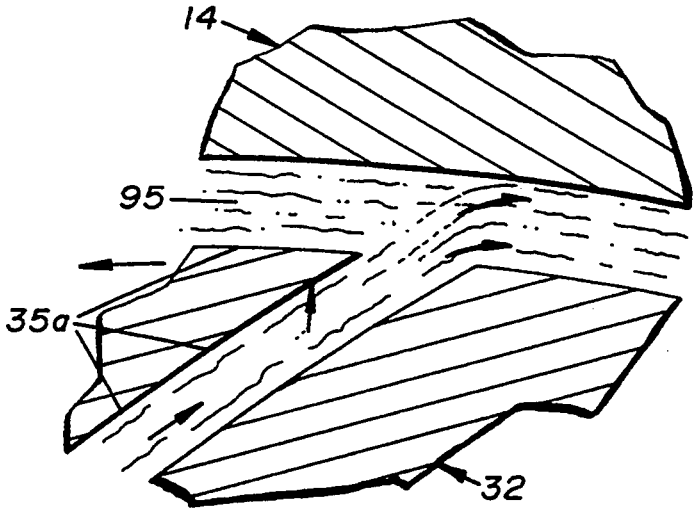
FIG. 6 is a cross-sectional view of liquid being forced out of the curved passageway and applying force to the leading edge thereof.

As shown more clearly in FIG. 6, since the curved passageways 35 are curved, the exiting liquid 95 is pushed against the leading walls 35(*a*)of the curved passageways 35, the leading walls 35(*a*) being strictly defined as the walls furthest disposed in the direction of rotation. This mechanical energy is absorbed by the leading walls 35(*a*) of the curved passageways 35 and is used to propel the rotor disk 32 in the direction of rotation. This significantly decreases the horsepower necessary to drive the rotor disk 32, increasing the apparatus' efficiency of operation. Also during this "expansion phase," the pressure inside the curved passageways 35 changes from a negative pressure state or deep vacuum state to a very positive pressure state almost instantaneously due to the conversion of the liquid 95 to vapor and the subsequent rapid expansion of the vapor. The pressure differential is estimated to be approximately 97 lbs./sq. in. where water is the liquid 95 being heated. Different liquids would exhibit different boiling characteristics and corresponding pressure differentials. This increase in pressure causes a slight rise in the temperature of the vapor which is thermodynamically communicated to the liquid 95 exiting the curved passageways 35. This rise in temperature is also supplemented by the frictional heat energy generated as the liquid 95 pushes against the walls of the curved passageways 35 while exiting.

When the vapor bubble "V" between the air bubble "A" and the remaining liquid has expanded to its greatest volume, the heat therein is drawn into the cooler, adjacent liquid remaining in the outer extremities of the curved passageways 35, causing the air bubble "A" to cool and become correspondingly lessor in volume. This begins what will be referred to as the "contraction phase" of the cycle.

As the vapor cools, it "collapses" or condenses back into a liquid, drawing cooler liquid 95 from the circumjacent liquid 95 contained in the rotor cavity 15, back into the curved passageways 35 via the openings located in the circumferential sides of the rotor disk 32. This collapsing of the vapor bubble happens very rapidly, and the liquid 95 is drawn back into the curved passageways 35 at a high velocity. When the vapor bubble has completely collapsed, the velocity of the incoming liquid 95 is suddenly extinguished, resulting in what is commonly known as "water hammer". The effect of this "water hammer" phenomenon is a momentary, sharp rise in pressure due to impact, and a slight rise in the temperature of the liquid 95. Again, the rise in temperature is supplemented to a small degree by the frictional heat energy generated as the liquid 95 rushes by the internal walls of the curved passageways 35 while re-entering at high velocity.

The shock effect of the "water hammer" is dynamically reduced by two phenomena. First, as the volume and the mass of the liquid 95 in the curved passageways 35 increase due to liquid 95 being drawn into the curved passageways 35, the amount of centrifugal force in the opposite direction being generated by the rotation of the rotor disk 32 is increased. This acts as a brake to slow down the re-entry of the liquid 95 into the curved passageways 35. Second, when the vapor bubble completely collapses, the incoming liquid 95 actually impacts the air bubble trapped in the bottom of the curved passageways 35. This impact by the liquid 95 on the trapped air bubble is known as an "elastic impact" and is characterized by a momentary compression of the air bubble immediately followed by the restitution or rebounding of the air bubble. The compression of the air bubble causes a slight rise in temperature therein, which causes the air bubble to expand slightly in volume during the restitution or rebounding of the air bubble. Some of this heat energy is also communicated to the adjacent liquid 95. This "elastic impact" minimizes the intensity of the shock of impact normally associated with "water hammer" without losing the desired rise in temperature. The restitution or rebounding of the air bubble effectively reverses the direction of flow of the liquid 95 in the curved passageways 35, and concludes the "contraction phase" of the action cycle.

The combined expansion and contraction phases of the action cycle occur with a very high frequency, and are repeated many times to effect a spectacular rise in the temperature of the liquid 95 being acted upon. As shown in FIG. 2, the heated liquid 96 and vapor 97 exit the front section 14 of the housing structure 12 via the central shaft bore 22 located on the separator plate 20, and enter the fluid separation chamber 26. The heated liquid 96 gravitates to the bottom of the fluid separation chamber 26 exits thereof via the liquid outlet port 73. The vapor 97 rises inside the fluid separation chamber 26 and exits thereof via the vapor outlet port 72. As the vapor 97 exits the fluid separation chamber 26, outside cool air is drawn into the fluid separation chamber 26 through the space located between the shaft 52 and the central shaft bore 28. The flow of the incoming cool air prevents the heated liquid 96 from escaping the fluid separation chamber 26 through the central shaft bore 28, thereby aerodynamically sealing the shaft 52 on the motor 54.

In compliance with the statute, the invention, described herein, has been described in language more or less specific as to structural features. It should be understood, however, the invention is not limited to the specific features shown, since the means and construction shown comprised only the preferred embodiments for putting the invention into effect. The invention is, therefore, claimed in any of its forms or modifications within the legitimate and valid scope of the amended claims, appropriately interpreted in accordance with the doctrine of equivalents.

I claim:

1. An apparatus for heating liquids, comprising:

a. a closed housing structure, said housing structure having a cylindrical shaped rotor chamber formed therein, said rotor chamber being filled with a liquid to be heated;

b. a rotor disk disposed inside rotor chamber and capable of being rotated in a forward direction therein, said rotor disk having an outer circumferential surface and a plurality of outward radiating, curved passageways formed therein, each said curved passageway having a closed end located near the center of said rotor disk and an outer opening located along said outer circumferential surface of said rotor disk, said curved passageways being curved in an arc opposite to the direction of rotation of said rotor disk;

c. a motive means for rotating said rotor disk in one direction inside said housing structure;

d. at least one liquid inlet port formed in said housing structure enabling a liquid to flow therein, and;

e. at least one outlet port formed on said housing structure to allow heated liquid or vapor formed in said housing structure to selectively exit therefrom during use.

2. An apparatus, as recited in claim 1, further comprising said housing structure comprises a front section and a rear section with a separation plate disposed therebetween, said rotor chamber being located in said front section, and a fluid separation chamber formed in said rear section.

3. An apparatus, as recited in claim 2, wherein said motive means is an electric motor with a rotating shaft aligned longitudinally inside said housing structure being attached to said rotor disk to rotate said rotor disk inside said rotor chamber

4. An apparatus, as recited in claim 3, further including a gasket dispose between said front section and said separation plate and a gaske between said rear section and said fluid separation chamber to prevent leakage.

5. An apparatus, as recited in claim 3, wherein said electric motor is arranged to rotate said rotor disk approximately 3,450 RPM's.

6. An apparatus, as recited in claim 5, further including a slinger disposed on said shaft inside said rear section, said slinger being rotated by said shaft during operation to force liquid disposed on said shaft outward and away therefrom.

7. An apparatus, as recited in claim 6, further including a drip diverter disposed inside said rear section, said drip diverter being for preventing condensation droplets formed inside said rear section from falling onto said shaft.

8. An apparatus for heating liquids, comprising:

a. a closed housing structure, said housing structure having adjacent rotor and fluid separation chambers formed therein;

b. a motor attached to said housing structure, said motor having a shaft extending through said fluid separation chamber and into said rotor chamber of said housing structure, said motor rotating said shaft in one direction;

c. a rotor disk connected to said shaft and disposed inside said rotor chamber of said housing structure, said rotor disk having an outer, circumferental surface, said rotor having a plurality of outward radiating, curved passageways formed therein, said curved passageways being closed at one end near the center of said rotor disk and having an outer opening formed along said outer surface of said rotor disk;

d. at least one liquid inlet port formed on said housing structure to allow said liquid to flow into said rotor chamber;

e. at least one liquid outlet port formed on said housing structure to allow heated liquid heated formed inside said housing structure to be removed therefrom during use, and;

f. at least one vapor outlet port formed on said housing structure to allow heated vapor formed inside said housing structure to be removed therefrom during use.

9. An apparatus as recited in claim 8, further including a separation plate disposed between said front and said fluid separation chambers, said separation plate having a central shaft bore formed therein to allow said shaft of said motor to extend through said separation plate and into said rotor chamber of said housing structure.

10. An apparatus as recited in claim 9, further including a drip diverter located inside said fluid separation chamber for preventing condensation forming in said fluid separation chamber from falling onto said shaft when said shaft is rotated by said motor.

11. An apparatus as recited in claim 10, further including a slinger attached to said fluid shaft and disposed inside said separation chamber said slinger being for forcing liquid located on said shaft outward to the outer surfaces of said fluid separation chamber.

12. An apparatus as recited in claim 10, wherein said motor is arranged for rotating said shaft at approximately 3,450 revolutions per minute.

13. An apparatus as recited in claim 12 wherein said curved passageways are approximately 1/16 inch in diameter.

14. An apparatus as recited in claim 12 wherein said inside surface of said housing structure and said outer surface of said rotor disk are spaced apart approximately 1/16 inch.

15. An apparatus as recited in claim 12 wherein said curved passageways form an arc whose tangent intersects at an angle of 45 degrees, a line drawn radially from the starting point of the arc to said circumferential surface edge of said rotor disk at an angle of 0 degrees.

* * * * *